US007985098B2

(12) United States Patent
De Chazal et al.

(10) Patent No.: US 7,985,098 B2
(45) Date of Patent: Jul. 26, 2011

(54) FUSE CONNECTOR ASSEMBLY

(75) Inventors: Aaron James De Chazal, Rochester, MI (US); Adam Price Tyler, Rochester Hills, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 50 days.

(21) Appl. No.: 12/539,311

(22) Filed: Aug. 11, 2009

(65) Prior Publication Data

US 2010/0124834 A1 May 20, 2010

Related U.S. Application Data

(60) Provisional application No. 61/199,838, filed on Nov. 20, 2008, provisional application No. 61/199,766, filed on Nov. 20, 2008, provisional application No. 61/201,605, filed on Dec. 12, 2008.

(51) Int. Cl.
*H01R 13/68* (2006.01)

(52) U.S. Cl. ..... 439/620.31

(58) Field of Classification Search ..... 439/271, 439/709, 138, 620.31; 337/208, 211; 361/117, 361/127, 126, 119, 760
See application file for complete search history.

(56) References Cited

U.S. PATENT DOCUMENTS

| | | | | |
|---|---|---|---|---|
| 3,218,413 | A | 11/1965 | Poehlman, Jr. | |
| 3,320,383 | A | 5/1967 | Koetter | |
| 3,924,914 | A | 12/1975 | Banner | |
| 4,178,061 | A | 12/1979 | Ahroni | |
| 4,408,822 | A | 10/1983 | Nikitas | |
| 4,426,127 | A | 1/1984 | Kubota | |
| 4,575,704 | A | 3/1986 | Pezold | |
| 5,137,473 | A | 8/1992 | Nickola | |
| 5,480,323 | A * | 1/1996 | Mews et al. | 439/395 |
| 5,668,698 | A * | 9/1997 | Jozwiak et al. | 361/752 |
| 6,095,843 | A * | 8/2000 | Kaneko et al. | 439/352 |
| 6,869,313 | B2 * | 3/2005 | Gibboney | 439/620.15 |
| 7,021,968 | B1 * | 4/2006 | Lu | 439/620.07 |
| 7,186,146 | B1 | 3/2007 | Chang et al. | |
| 7,613,003 | B2 | 11/2009 | Pavlovic et al. | |
| 2003/0001715 | A1 | 1/2003 | Montague | |
| 2005/0122696 | A1 | 6/2005 | Weisz et al. | |
| 2007/0293082 | A1 | 12/2007 | Sumitani et al. | |
| 2008/0303625 | A1 | 12/2008 | Ding | |

* cited by examiner

*Primary Examiner* — Edwin A. Leon

(57) ABSTRACT

A connector assembly for mating with a power distribution module is provided. The connector assembly includes a header connector assembly and a fuse connector assembly. The header connector assembly is configured to be mounted to the power distribution module. The header assembly includes contacts that are connected to a power supply circuit within the power distribution module. The fuse connector assembly is configured to mate with the header assembly. The fuse connector assembly includes a fuse subassembly that has an insert body configured to hold a fuse and conductive terminals. The conductive terminals are mounted to the insert body and are configured to electrically couple with the fuse to establish a fused conductive pathway. The fuse subassembly mates with the contacts in the header assembly to electrically couple the fused conductive pathway with the power supply circuit of the power distribution module.

24 Claims, 5 Drawing Sheets

FUSE CONNECTOR ASSEMBLY

CROSS-REFERENCE TO RELATED APPLICATIONS

This application relates to and claims priority benefit to U.S. Provisional Application No. 61/199,838, filed Nov. 20, 2008, and entitled "Integrated Fuse Connector Assembly" (the "'838 Application"), U.S. Provisional Application No. 61/199,766, filed Nov. 20, 2008, and entitled "Integrated Fuse Terminal Assembly" (the "'766 Application"), and U.S. Provisional Application No. 61/201,605, filed Dec. 12, 2008, and entitled "Connector Assembly With Two Stage Latch" (the "'605 Application"). This application also is a continuation-in-part of co-pending U.S. Nonprovisional Application Ser. No. 12/539,261, filed Aug. 11, 2009, and entitled "Connector Assembly With Two-Stage Latch" (the "261 Application"). The '261 Application relates to and claims priority benefit to the '605 Application. The entire disclosures of the '838, '766, '605 and '261 Applications are incorporated by reference herein in their entirety.

BACKGROUND OF THE INVENTION

This invention relates generally to fused connectors, and more particularly, to externally mounted fused connectors.

Fuses may be used to protect electronic devices from power overloads or excess surges in a circuit that includes a fuse and the electronic device. The fuses may be placed in the circuit along the feed line, or conductive pathway, along which electrical power or current is supplied to the device. Some known fuses are designed to fail and open if the electrical power or current exceeds a predetermined power or current threshold of the fuses. For example, if the current supplied along a circuit surges and increases above the threshold of the fuse, a conductive portion of the fuse may melt or break to thereby electrically open the fuse. The open fuse creates a gap along the circuit and electrically opens the circuit. The electric power or current may then no longer be supplied to the electronic devices positioned along the open circuit.

In some known high voltage applications, such as the automotive industry, fuses may be housed inside relatively expensive power distribution boxes or modules. These power distribution boxes may supply high voltage electric power or current to one or more devices in a vehicle, such as a heating or air conditioning unit. Some known power distribution boxes include fuses that are internally mounted in the boxes. For example, the fuses may not be accessible on the exterior or outside surface of the boxes. The fuses may be placed inside the power distribution boxes to ensure that the fuses are located within an shield of the power distribution box.

In the event of a failed or blown fuse, the power distribution boxes must be opened to access the fuses therein. But, the fuses may be permanently fixed within the power distribution box or may be inaccessible due to the location of the fuse within the box. Consequently, in the event of a fuse failure, some known power distribution boxes may need to be entirely replaced. Alternatively, the replacement of an internal fuse that is not easily accessible may be relatively expensive and time intensive.

A need exists for an assembly that provides a more accessible and/or easily replaceable fuse.

BRIEF DESCRIPTION OF THE INVENTION

In one embodiment, a connector assembly for mating with a power distribution module is provided. The connector assembly includes a header connector assembly and a fuse connector assembly. The header connector assembly is configured to be mounted to the power distribution module. The header assembly includes contacts that are connected to a power supply circuit within the power distribution module. The fuse connector assembly is configured to mate with the header assembly. The fuse connector assembly includes a fuse subassembly that has an insert body configured to hold a fuse and conductive terminals. The conductive terminals are mounted to the insert body and are configured to electrically couple with the fuse to establish a fused conductive pathway. The fuse subassembly mates with the contacts in the header assembly to electrically couple the fused conductive pathway with the power supply circuit of the power distribution module.

In another embodiment, a connector assembly for mating with a power distribution module having an open power supply circuit is provided. The connector assembly includes an outer housing and a fuse subassembly. The outer housing extends from a mating interface to a back end along a longitudinal axis. The mating interface is configured to mate with a header assembly mounted to an exterior surface of the power distribution module. The fuse subassembly is disposed in the outer housing and includes conductive terminals that are configured to mate with contacts in the header assembly of the power distribution module. The fuse subassembly is configured to retain a fuse that is electrically coupled with the conductive terminals. The conductive terminals and the fuse are electrically coupled with the contacts in the header assembly to close the power supply circuit when the outer housing mates with the header assembly.

DETAILED DESCRIPTION OF THE INVENTION

Figure 1:
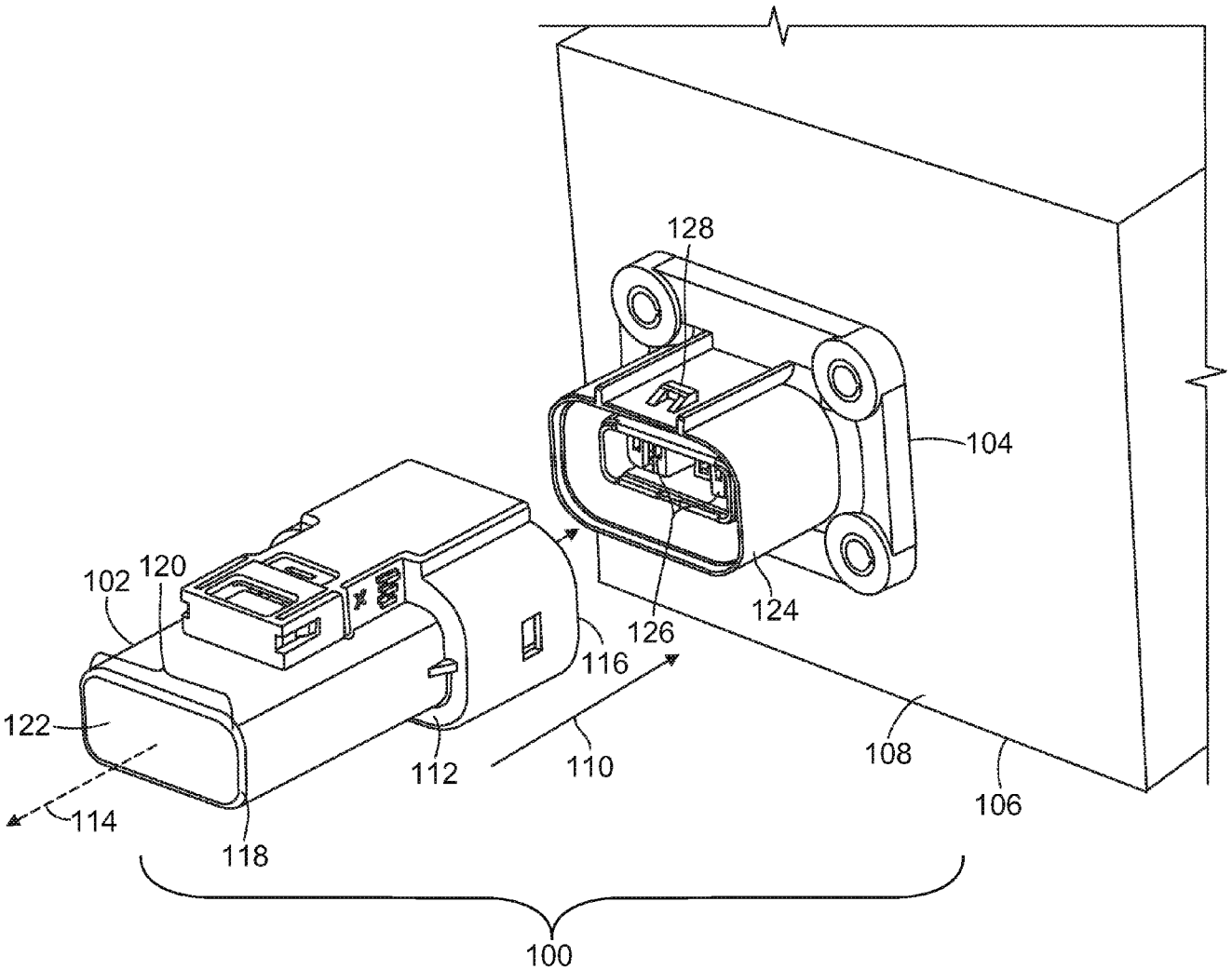
FIG. 1 is a perspective view of a connector assembly in accordance with one embodiment.

FIG. 1 is a perspective view of a connector assembly 100 in accordance with one embodiment. The connector assembly 100 provides a replaceable fuse assembly for a high voltage power system, such as a high voltage power system of a vehicle that is external to a power distribution module that supplies electric power to one or more air conditioning or heating units of the vehicle. For example, the HV connector assembly 100 may provide a fuse for a power system that provides direct electrical current at a voltage of at least about 30 volts or alternating electrical current at a voltage of at least about 15 volts. While the embodiments set forth below are described in terms of a high voltage power system for a vehicle, alternatively one or more embodiments may be applicable to systems other than a high voltage system or for power systems used with devices other than a vehicle. For example, one or more embodiments may be used in conjunction with a low voltage system or for a power system for a device other than a vehicle.

The connector assembly 100 includes an integrated fuse connector (IFC) assembly 102 and a header assembly 104. The header assembly 104 is externally joined with a power distribution module 106. For example, the header assembly 104 may be mounted to an exterior surface 108 of a high voltage power distribution module 106 for a vehicle, such as a hybrid or electric automobile. The exterior surface 108 represents an outer boundary or exterior perimeter of the power distribution module 106. For example, the exterior surface 108 may represent the outside surfaces of a housing or casing of a power distribution module 106. The IFC assembly 102 mates with the header assembly 104 along a mating direction 110 to electrically couple the IFC assembly 102 with the power distribution module 106. The IFC assembly 102 includes conductive terminals 240, 242 (shown in FIG. 2) that mate with contacts 126 in the header assembly 104 to electrically join the IFC assembly 102 with the power distribution module 106 and to close an open power supply circuit 700 (shown in FIG. 7) with a fused conductive pathway 720 (shown in FIG. 7) that extends through the IFC assembly 102. The mating of the IFC assembly 102 and the header assembly 104 introduces an external fuse 250 (shown in FIG. 2) to the power distribution module 106 that may be more easily removed and replaced than fuses that are internally mounted or located inside the power distribution module 106.

The IFC assembly 102 includes an outer housing 112 that extends along a longitudinal axis 114 from a mating interface end 116 to a back end 118. In the illustrated embodiment, the mating interface end 116 is opposite of the back end 118. Alternatively, the mating interface end 116 and the back end 118 may be angled with respect to one another. The mating interface end 116 engages the header assembly 104 to mate the IFC assembly 102 with the header assembly 104. For example, the mating interface end 116 may be received in the header assembly 104 to couple the IFC assembly 102 and the header assembly 104. The back end 118 may be closed and not provide an opening to a fuse subassembly 236 (shown in FIG. 2). Alternatively, the back end 118 may define an access opening 120 that circumferentially surrounds an outer perimeter of a rear end 122 of the IFC assembly 102. The outer housing 112 may include, or be formed from, a dielectric material. For example, the outer housing 112 may be molded from one or more polymers.

The header assembly 104 includes a receptacle shroud 124 that receives the outer housing 112 in the illustrated embodiment. The receptacle shroud 124 may include a latch protrusion 128 that is engaged by a latch 202 (shown in FIG. 2) to secure the IFC assembly 102 to the header assembly 104. Contacts 126 disposed within the receptacle shroud 124 mate with the conductive terminals 240, 242 (shown in FIG. 2) of the IFC assembly 102 when the IFC assembly 102 and header assembly 104 mate with one another. The contacts 126 electrically couple the power distribution module 106 with the IFC assembly 102.

Figure 2:
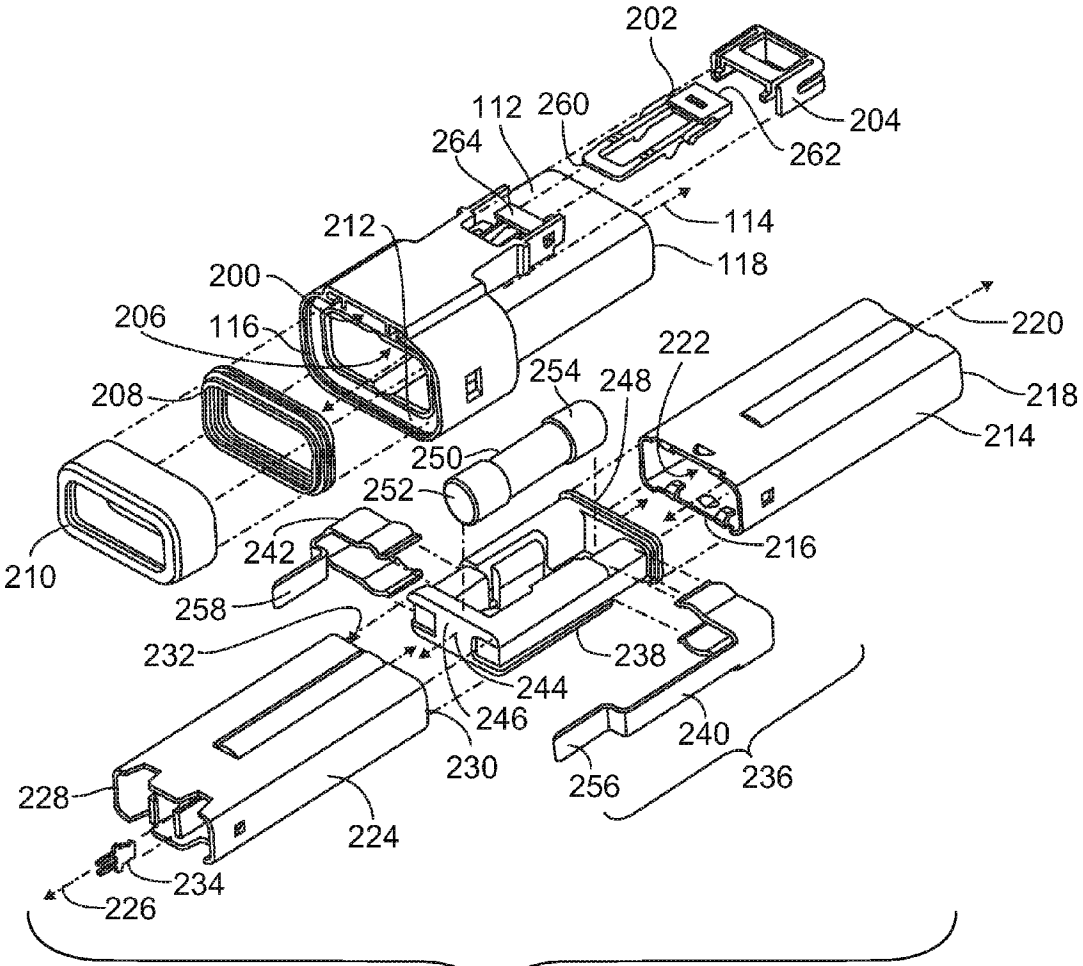
FIG. 2 is an exploded view of an integrated fuse connector (IFC) assembly shown in FIG. 1 in accordance with one embodiment.

FIG. 2 is an exploded view of the IFC assembly 102 in accordance with one embodiment. The outer housing 112 includes a latch chamber 200 into which a latch 202 is placed. The latch 202 engages the header assembly 104 (shown in FIG. 1) to secure the IFC assembly 102 and header assembly 104 together in a mated relationship. In one embodiment, the latch 202 is configured similar to the floating latch 202 described in the '261 Application and/or the '605 Application. In addition to the latch 202, the outer housing 112 may include a flexible latch 264 that is configured similar to the flexible latch 264 described in the '261 Application and/or the '605 Application. The floating latch 202 and flexible latch 264 may provide a two-stage latching or mating sequence that mates different groups of conductive terminals and/or contacts in the IFC assembly 102 and the header assembly 104 (shown in FIG. 1) with one another in a predefined sequence. For example, the latch 202 may be slidably secured to the outer housing 112 such that the latch 202 can slide relative to the outer housing 112 during mating of the outer housing 112 and header assembly 104. During the mating of the outer housing 112 with the header assembly 104, the latch 202 may move with the outer housing 112 toward the header assembly 104 until one end 260 of the latch 202 engages and latches onto the latch protrusion 128 (shown in FIG. 1) of the header assembly 104. The latch 202 may then remain substantially stationary while the outer housing 112 continues to move toward and/or into the header assembly 104. The latch 202 may slide relative to the outer housing 112 within the latch chamber 200 until an opposite end 262 of the latch 202 engages and latches onto the flexible latch 264. The latch 202 then has secured the outer housing 112 to the header assembly 104. A latch cap 204 at least partially encloses a rear portion of the latch 202 between the latch cap 204 and the outer housing 112.

The outer housing 112 defines an interior chamber 206 that extends from the mating interface end 116 toward the back end 118. In one embodiment, the interior chamber 206 extends through the outer housing 112 along the longitudinal axis 114 from the mating interface end 116 to the back end 118. The mating interface end 116 and the back end 118 circumferentially enclose outer perimeters of the interior chamber 206 at the corresponding mating interface end 116 or back end 118. The mating interface end 116 may include an inwardly extending slot 212 that disposed around the interior chamber 206 at the mating interface end 116. As described below, the slot 212 may receive a seal element 208 and the seal retainer body 210.

In the illustrated embodiment, the IFC assembly 102 includes the seal element 208 disposed at or around the mating interface end 116 of the outer housing 112. For example, the seal element 208 may be provided along the outer perimeter of the interior chamber 206 at the mating interface end 116. At least a portion of the seal element 208 may be located in the slot 212 of the outer housing 112. The seal element 208 includes one or more elastomeric bodies that provide a seal against the ingress of contaminants, such as moisture, into the interior chamber 206 of the outer housing 112 through the mating interface end 116. For example, the seal element 208 may be compressed between the header assembly 104 (shown in FIG. 1) and the outer housing 112 to seal the interior chamber 206 from the ingress of moisture.

A seal retainer body 210 may be secured to the mating interface end 116 of the outer housing 112 to hold the seal element 208 at the mating interface end 116. The seal retainer body 210 may be a rigid body that at least partially compresses the seal element 208 between the seal retainer body 210 and the outer housing 112. In one embodiment, the seal retainer body 210 is at least partially received in the slot 212 of the outer housing 112 to secure the seal element 208 between the seal retainer body 210 and the outer housing 112 along the outer perimeter of the mating interface end 116.

An electromagnetic shield 214 is disposed within the interior chamber 206 of the outer housing 112. The shield 214 extends between opposite ends 216, 218 along a central axis 220. The shield 214 defines an interior chamber 222 that extends through the shield 214 from one end 216 to the other end 218. Alternatively, the interior chamber 222 may extend from one end 216, 218 toward the other end 216, 218, but not all of the way through the shield 214. The shield 214 may include, or be formed from, a conductive material. For example, the shield 214 may be stamped and formed from a sheet of a tin-plated copper alloy. The shield 214 may be electrically coupled with an electric ground reference of the power distribution module 106 (shown in FIG. 1) when the IFC assembly 102 mates with the header assembly 104 (shown in FIG. 1). For example, the shield 214 may mate with one or more contact terminals (not shown) of the header assembly 104 that are electrically coupled with an electric ground reference when the IFC assembly 102 and header assembly 104 engage one another. The shield 214 may shield one or more components disposed within the shield 214 from electromagnetic interference by conducting the electromagnetic interference to the ground reference.

An interior housing 224 is disposed within the interior chamber 222 of the shield 214. The interior housing 224 extends along a center axis 226 from a mating interface end 228 to a back end 230. In the illustrated embodiment, the mating interface end 228 is opposite of the back end 230. Alternatively, the mating interface end 228 and the back end 230 may be angled with respect to one another. The mating interface end 228 engages the header assembly 104 (shown in FIG. 1) when the IFC assembly 102 mates with the header assembly 104. The interior housing 224 includes an inner chamber 232 that extends from the back end 230 toward the mating interface end 228 along the center axis 226. In one embodiment, the inner chamber 232 does not extend all the way through the interior housing 224 and instead only extends partially through the interior housing 224 from the back end 230. The interior housing 224 may include, or be formed from, a dielectric material. For example, the interior housing 224 may be molded from one or more polymer materials.

An electric shunt 234 is disposed at or proximate to the mating interface end 228 of the interior housing 224. The electric shunt 234 may be press-fit into the interior housing 224. Alternatively, the electric shunt 234 may be held in the interior housing 224 using an adhesive or solder. In one embodiment, the electric shunt 234 includes, or is formed from, a conductive material. For example, the electric shunt 234 may be stamped from a metal sheet. The electric shunt 234 may be a conductive body that mates with one or more contacts or conductive terminals (not shown) in the header assembly 104 (shown in FIG. 1) to close an electric circuit. For example, the header assembly 104 may include two or more contacts that are joined with an interlock circuit 716 (shown in FIG. 7), such as a high voltage interlock (HVIL) circuit. The interlock circuit 716 remains open until the IFC assembly 102 mates with the header assembly 104 and the electric shunt 234 engages the contacts in the header assembly 104. The electric shunt 234 may provide an electrically conductive pathway that closes the interlock circuit 716. The closing of the interlock circuit 716 may indicate to the power distribution module 106 (shown in FIG. 1) that the IFC assembly 102 is mated with the header assembly 104 and that the power distribution module 106 may begin passing electric current through the IFC assembly 102.

The fuse subassembly 236 is disposed within the interior housing 234 and includes the conductive terminals 240, 242. While two conductive terminals 240, 242 are shown in FIG. 2, alternatively a different number of conductive terminals 240, 242 may be provided. The insert body 23 extends along a center axis 244 from a front end 246 to a rear end 248. The insert body 238 holds a fuse 250 that is oriented along the center axis 244. For example, the fuse 250 may be loaded into and secured in the insert body 238 until the fuse 250. In one embodiment, the fuse 250 is fixed in position in the insert body 238 such that the fuse subassembly 236 and/or the IFC assembly 102 is replaced in the event of a blown or failed fuse 250. Alternatively, the insert body 238 may removably hold or secure the fuse 250 such that the fuse subassembly 236 and/or the insert body 238 may be removed from the IFC assembly 102 and the fuse 250 removed from the insert body 238 to replace a blown or failed fuse 250. The fuse 250 may then be removed from the insert body 238 and a new or replacement fuse 250 may be loaded therein. The insert body 238 may include, or be formed from, a dielectric material. For example, the insert body 238 may be molded from one or more polymer materials.

The conductive terminals 240, 242 are mounted to the insert body 238. The conductive terminals 240, 242 are electrically interconnected by the fuse 250. For example, each of the conductive terminals 240, 242 may engage an opposite conductive end cap 252, 254 of the fuse 250 and be electrically coupled by the fuse 250. In the illustrated embodiment, the conductive terminal 240 engages the end cap 254 and the conductive terminal 242 engages the end cap 252. The coupling of the conductive terminals 240, 242 to the fuse 250 establishes the fused conductive pathway 720 (shown in FIG. 7). Mating ends 256, 258 of the conductive terminals 240, 242 may mate with contacts 126 (shown in FIG. 1) of the header assembly 104 (shown in FIG. 1) to electrically couple the conductive terminals 240, 242 and the fuse 250 with the power distribution module 106 (shown in FIG. 1). For example, the conductive terminals 240, 242 and the fuse 250 may provide the fused conductive pathway 720 that closes the power supply circuit 700 (shown in FIG. 7) of the power distribution module 106. The conductive terminals 240, 242 may include, or be formed from, a conductive material. For example, the conductive terminals 240, 242 may be stamped and formed from a sheet of a metal or metal alloy.

Two or more components of the IFC assembly 102 may nest within one another. For example, the fuse subassembly 236 may be disposed within the inner chamber 232 of the interior housing 224 such that the center axis 244 of the fuse subassembly 236 is disposed along or parallel to the center axis 226 of the interior housing 224. The interior housing 224 may be located within the interior chamber 222 of the shield 214 such that the center axis 226 of the interior housing 224 is aligned with the central axis 220 of the shield 214. The shield 214 may be loaded into the interior chamber 206 of the outer housing 112 such that the central axis 220 of the shield 214 is oriented along the longitudinal axis 114 of the outer housing 112.

Figure 3:
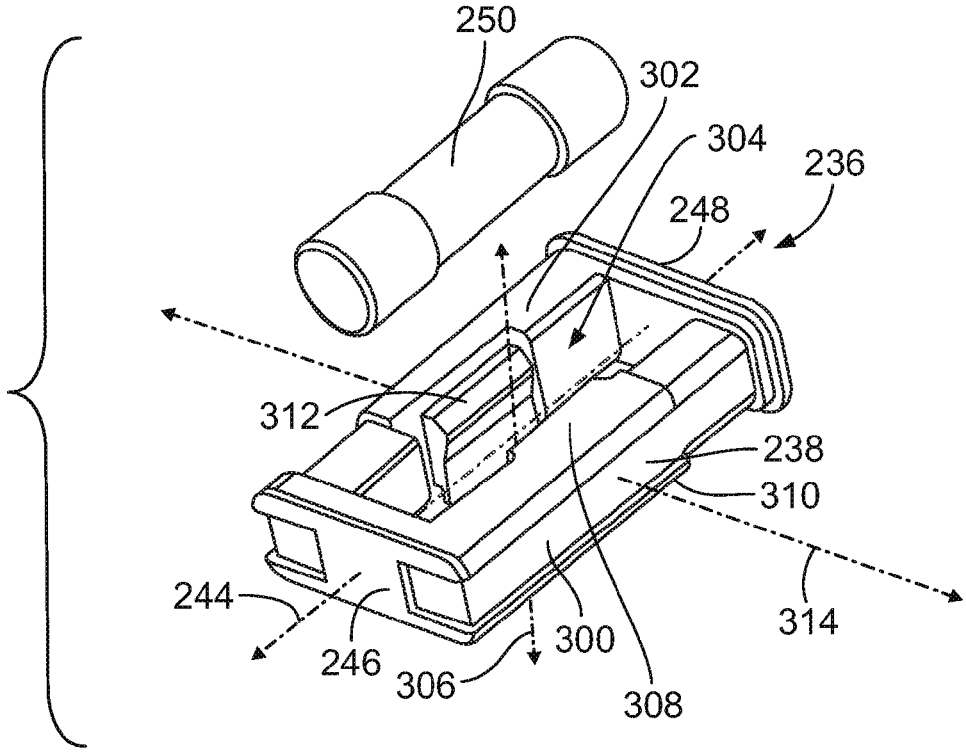
FIG. 3 is a perspective view of a fuse-subassembly shown in FIG. 2 prior to loading a fuse and mounting conductive terminals to the fuse subassembly in accordance with one embodiment.

FIGS. 3 through 6 illustrate perspective views of the fuse subassembly 236 during different stages of assembly in accordance with one embodiment. FIG. 3 is a perspective view of the fuse subassembly 236 prior to loading the fuse 250 and mounting the conductive terminals 240, 242. The insert body 238 includes a top side 308 and a bottom side 310. The top side 308 and bottom side 310 oppose one another along a vertical axis 306. The vertical axis 306 is perpendicular with respect to the center axis 244 in the illustrated embodiment.

The insert body 238 includes two rails 300, 302 that extend parallel to the center axis 244 of the insert body 238. The rails 300, 302 extend from the front end 246 to the rear end 248. An elongated channel 304 is located between the rails 300, 302 and defines an opening that extends from the top side 308 to the bottom side 310 and between the rails 300, 302. As shown in FIG. 3, the channel 304 is oriented along the center axis 244. The channel 304 is shaped to removably receive the fuse 250. For example, the rails 300, 302 may be separated by a sufficiently large distance that the fuse 250 may be secured between the rails 300, 302 by an interference fit.

In the illustrated embodiment, each of the rails 300, 302 includes a latch 312 that opposes the latch 312 of the other rail 300, 302. The latches 312 flex toward and away one another to snapably receive and secure the fuse 250 between the rails 300, 302. For example, each latch 312 may move in opposite directions along a lateral axis 314 that is oriented perpendicular with respect to the center and vertical axes 244, 306. Each latch 312 may flex toward the respective rail 300, 302 to which the latch 312 is coupled to increase the width of the channel 304 along the lateral axis 314 when the fuse 250 is inserted between the rails 300, 302. Conversely, each latch 312 may flex away from the respective rail 300, 302 to which the latch 312 is coupled once the fuse 250 is loaded into the channel 304 between the rails 300, 302 to decrease the width of the channel 304 and secure the fuse 250 between the rails 300, 302. The latches 312 may be spring loaded such that the latches 312 move toward the opposite rail 300, 302 when the fuse 250 is removed from the channel 304 and snap toward one another to apply a restorive force toward one another and against opposite sides of the fuse 250 to secure the fuse 250 in the channel 304.

Figure 4:
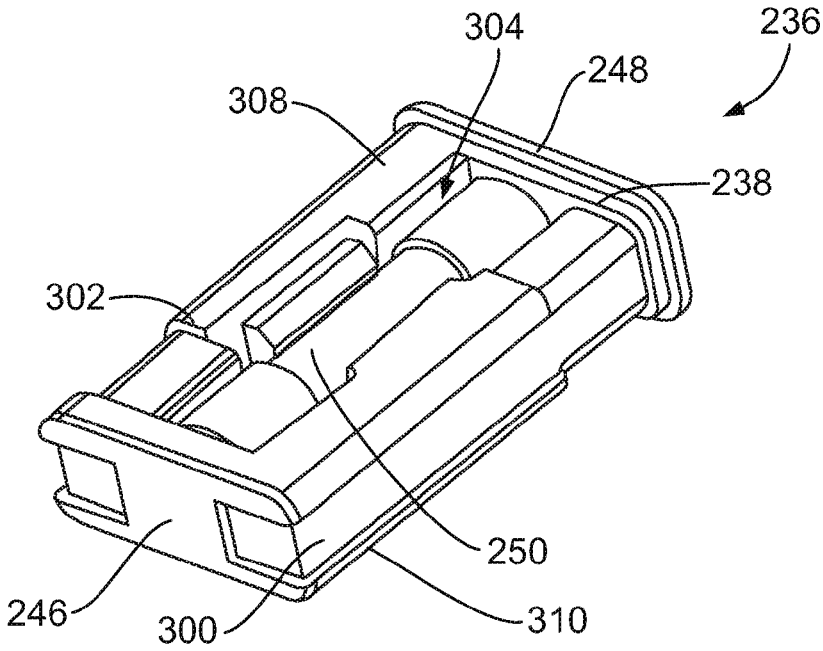
FIG. 4 is a perspective view of the fuse subassembly with a fuse loaded therein in accordance with one embodiment.

FIG. 4 is a perspective view of the fuse subassembly 236 with the fuse 250 loaded into the insert body 238 in accordance with one embodiment. The fuse 250 may be loaded and/or removed from the channel 304 of the insert body 238 through either the top or bottom sides 308, 310. The fuse 250 is extends from the front end 246 to the rear end 248 and between the rails 300, 302 when the fuse 250 is loaded into the insert body 238.

Figure 5:
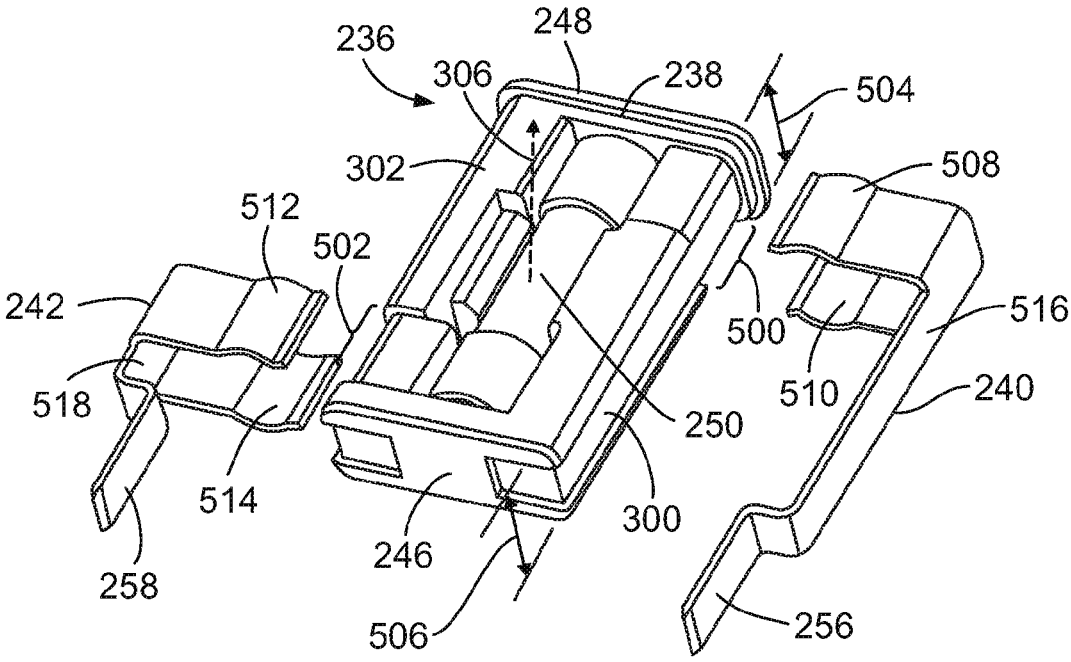
FIG. 5 is an exploded perspective view of the fuse subassembly with a fuse loaded therein and conductive terminals mounted therein in accordance with one embodiment.

FIG. 5 is an exploded perspective view of the fuse subassembly 236 with a fuse 250 loaded therein and conductive terminals mounted therein 240, 242 in accordance with one embodiment. The rails 300, 302 include narrowed portions 500, 502 located at, adjacent, or proximate to a different one of the front and rear ends 246, 248. For example, the narrowed portion 500 of the rail 300 may extend from the rear end 248 toward the front end 246 while the narrowed portion 502 of the rail 302 may extend from the front end 246 toward the rear end 248. The narrowed portions 500, 502 include subsections of the lengths of the rails 300, 302 that have a height dimension 504 that is less than a height dimension 506 of a different subsection, or a remainder, of the respective rail 300, 302. For example, the height dimension 504 of the narrowed portions 500, 502 may be smaller than the height dimension 506 of the remainder of the rails 300, 302. The height dimensions 504, 504 may be measured between the top and bottom sides 308, 310 along the vertical axis 306.

The conductive terminals 240, 242 engage the rails 300, 302 to mount the conductive terminals 240, 242 to the insert body 238. For example, the conductive terminal 240 includes opposing arms 508, 510 that engage the narrowed portion 500 of the rail 300 while the conductive terminal 242 includes opposing arms 512, 514 that engage the narrowed portion 502 of the rail 302. The conductive terminal 240 may be snapably coupled to the rail 300. For example, the conductive terminal 240 may be secured to the rail 300 by a snap-fit connection between the arms 508, 510 and the narrowed portion 500. The conductive terminal 242 may be snapably coupled to the rail 302. For example, the conductive terminal 242 may be secured to the rail 302 by a snap-fit connection between the arms 512, 514 and the narrowed portion 502. The arms 508, 510 of the conductive terminal 240 are joined to the mating end 256 by an elongated, substantially planar body 516. Similarly, the arms 512, 514 of the conductive terminal 242 are joined to the mating end 258 by an elongated, substantially planar body 518. As the conductive terminal 242 is shorter in length than the conductive terminal 240, the body 518 of the conductive terminal 242 may be shorter than the length of the body 516 of the conductive terminal 240. As shown in FIG. 5, the bodies 516, 518 may be substantially parallel to one another and to the vertical axis 306.

Figure 6:
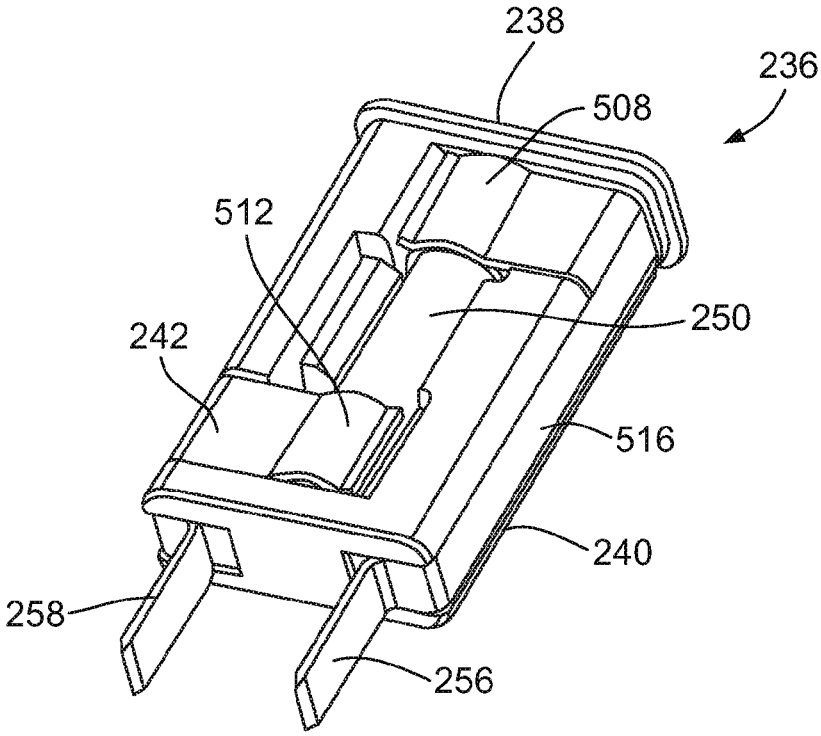
FIG. 6 is another perspective view of the fuse subassembly with a fuse and conductive terminals loaded therein in accordance with one embodiment.

FIG. 6 is a perspective view of the fuse subassembly 236 with the fuse 250 and conductive terminals 240, 242 loaded therein in accordance with one embodiment. The conductive terminals 240, 242 engage the fuse 250 once the fuse 250 is loaded into the insert body 238 and the conductive terminals 240, 242 are mounted or secured to the insert body 238. For example, the arms 508, 510 (shown in FIG. 5) of the conductive terminal 240 may snap onto the end cap 254 (shown in FIG. 2) of the fuse 250 while the arms 512, 514 (shown in FIG. 5) of the conductive terminal 242 snap onto the end cap 252 (shown in FIG. 2) of the fuse 250. The engagement between the conductive terminals 240, 242 and the fuse 250 provides a conductive pathway that extends through the conductive terminal 240, through the fuse 250 and through the conductive terminal 242. For example, the conductive pathway provided by the fuse 250 interconnecting the conductive terminals 240, 242 may extend from the mating end 256 of the conductive terminal 240, through the body 516 and arms 508, 510 of the conductive terminal 240, into the end cap 254, through the fuse 250, through the opposite end cap 252, into the arms 512, 514 of the conductive terminal 242, and through the body 518 (shown in FIG. 5) to the mating end 258 of the conductive terminal 242.

The mating ends 256, 258 of the conductive terminals 240, 242 mate with contacts 126 (shown in FIG. 1) of the header assembly 104 (shown in FIG. 1) to close the power supply circuit 700 (shown in FIG. 7) of the power distribution module 106 (shown in FIG. 1) with the conductive pathway that includes the conductive terminals 240, 242 and the fuse 250. As shown in FIG. 6, the fuse subassembly 236 is assembled together as a module that may be loaded into and removed from the IFC assembly 102 (shown in FIG. 1) to replace the fuse 250. In one embodiment, the fuse subassembly 236 may be snapably received and held in the IFC assembly 102. For example, the fuse subassembly 236 may snap into the IFC assembly 102 and be held by an interference fit that may be overcome to remove the fuse subassembly 236 by applying a removal force in an opposite direction.

Figure 7:
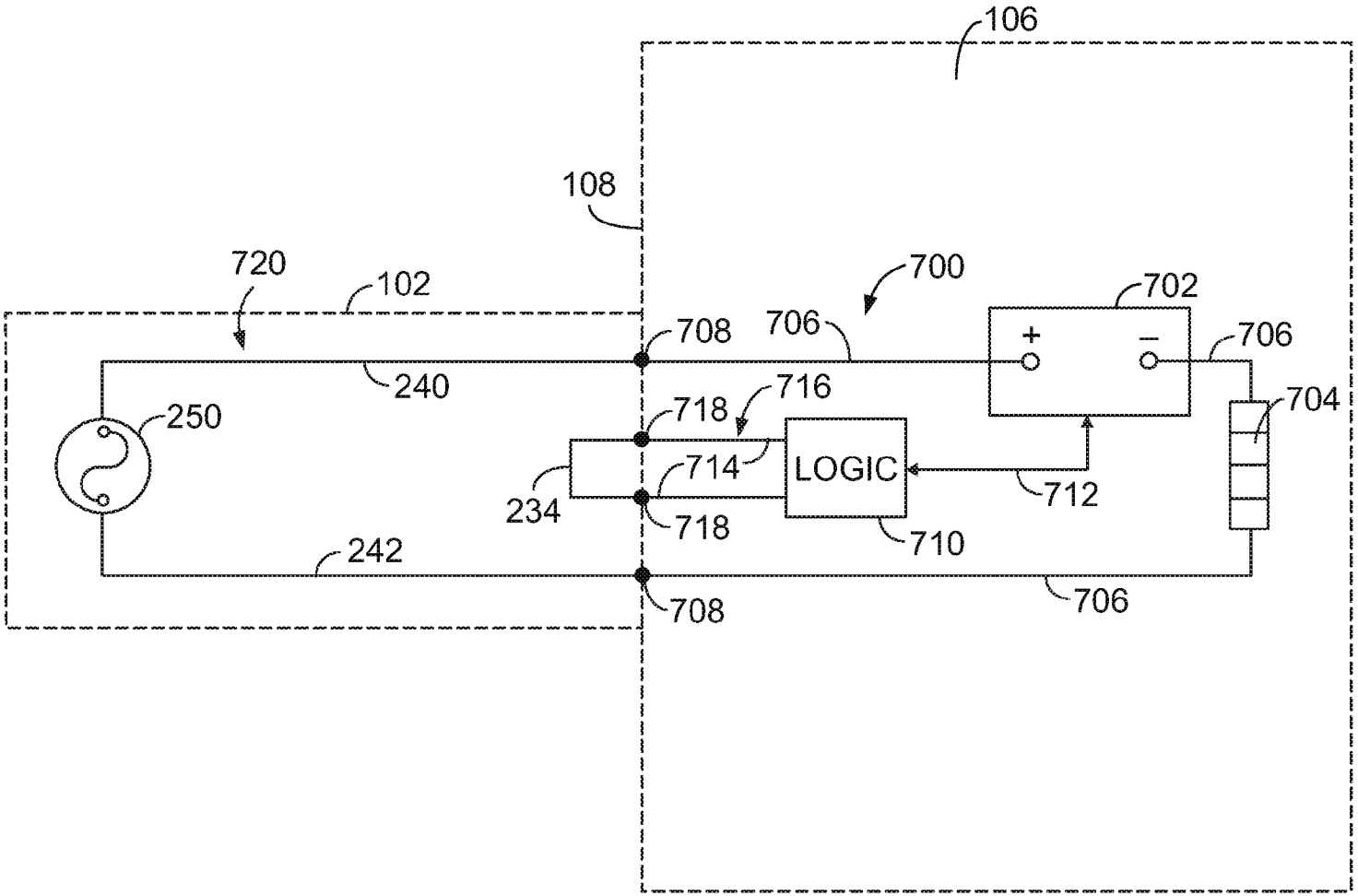
FIG. 7 is a schematic circuit diagram of the IFC assembly mated with a power distribution module shown in FIG. 1 in accordance with one embodiment.

FIG. 7 is a schematic circuit diagram of the IFC assembly 102 mated with the power distribution module 106 in accordance with one embodiment. The IFC assembly 102 and power distribution module 106 are shown in dashed lines to more clearly show the positions and locations of the IFC assembly 102 and power distribution module 106 relative to the power supply circuit 700 and the interlock circuit 716 shown in FIG. 7. As described above, the power distribution module 106 includes a power supply circuit 700. The power supply circuit 700 electrically interconnects a power source 702 with an electrical load 704. The power source 702 may be a high voltage power source. For example, the power source 702 may be a battery that supplies at least approximately 15 volts of alternating current or a source of at least approximately 30 volts of direct current. In the illustrated embodiment, the power source 702 is shown as a direct current power source, but alternatively may be an alternating current power source. The electrical load 704 includes a device, system, apparatus, or other component that receives and uses the current supplied by the power source 702. For example, in the illustrated embodiment, the electrical load 704 is shown as a heater. Alternatively, the electrical load 704 may be another device such as an air conditioning unit. While only a single power source 702 and a single electrical load 704 are part of the power supply circuit 700, alternatively the power supply circuit 700 may include multiple power sources 702 and/or electrical loads 704.

The fused conductive pathway 720 is internal to the IFC assembly 102 in one embodiment. For example, the fuse 250 and the conductive terminals 240, 242 (schematically represented in FIG. 7) may be internal to the IFC assembly 102. The fused conductive pathway 720 may be entirely enclosed within the IFC assembly 102, with no part or component of the fused conductive pathway 720 being separate from, or external to, the IFC assembly 102.

The power supply circuit 700 is internal to the power distribution module 106 in one embodiment. For example, the power supply circuit 700 may include the power source 702, the electrical load 704 and several conductive pathways 706 that internally interconnect the power source 702 and electrical load 704. The power supply circuit 700 may be entirely enclosed within the power distribution module 106. For example, the power source 702, electrical load 704 and conductive pathways 706 may not extend beyond the outer or exterior surfaces of the power distribution module 106. The conductive pathways 706 may extend to nodes 708 that are disposed at or near the exterior surface 108 of the power distribution module 106. For example, the conductive pathways 706 may be joined with the contacts 126 (shown in FIG. 1) of the header assembly 104 (shown in FIG. 1). The contacts 126 may be represented as the nodes 708 in FIG. 7.

The IFC assembly 102 mates with the header assembly 104 (shown in FIG. 1) of the power distribution module 106 to close the power supply circuit 700. Prior to mating the IFC assembly 102 with the power distribution module 106, the power supply circuit 700 may be an open circuit. For example, the power supply circuit 700 may be open between the nodes 708, or the contacts 126 (shown in FIG. 1), and electric current may not be passed along the power supply circuit 700 prior to mating the IFC assembly 102 with the power distribution module 106. The mating of the IFC assembly 102 with the power distribution module 106 closes the power supply circuit 700. For example, the mating of the IFC assembly 102 with the power distribution module 106 electrically joins the fused conductive pathway 720 across the nodes 708. The fused conductive pathway 720 bridges the gap between the nodes 708, or contacts 126, via the conductive terminals 240, 242 and the fuse 250. Electric current may pass along the power supply circuit 700 from the power source 702 to the electrical load 704 once the IFC assembly 102 mates with the power distribution module 106.

The power distribution module 106 may include a logic device 710 that communicates with the power source 702. The logic device 710 may be embodied in one or more computer logic components, such as a microcontroller, processor, microprocessor, computer, and/or software operating on a processor, microprocessor, or computer. The logic device 710 directs the power source 702 to supply and to cut off supply of current to the electrical load 704. For example, the logic device 710 may direct the power source 702 to begin supplying high voltage current to the electrical load 704 once the IFC assembly 102 is fully mated with the power distribution module 106. The logic device 710 may direct the power source 702 to stop supplying high voltage current to the electrical load 704 when the IFC assembly 102 is partially or no longer mated with the power distribution module 106. The logic device 710 may communicate with the power source 702 via control signals communicated via one or more conductive pathways 712.

An interlock circuit 716 in the power distribution module 106 electrically interconnects the logic device 710 with several conductive pathways 714 in the illustrated embodiment. The conductive pathways 714 electronically couple the logic device 710 with additional contacts (not shown) disposed in the header assembly 104 (shown in FIG. 1). For example, conductive pathways 714 may couple the logic device 710 with contacts in the header assembly 104 that are configured to mate with the electric shunt 234 of the IFC assembly 102. The contacts to which the conductive pathways 714 are joined are represented as nodes 718 in FIG. 7.

In one embodiment, the mating of the IFC assembly 102 with the power distribution module 106 closes the interlock circuit 716. For example, the mating of the IFC assembly 102 and header assembly 104 (shown in FIG. 1) may engage the electrical shunt 234 with the contacts, or nodes 718, of the interlock circuit 716 in the power distribution module 106. Prior to mating the IFC assembly 102 with the header assembly 104, the interlock circuit 716 may be open between the nodes 718. The electrical shunt 234 closes the interlock circuit 716 between the nodes 718. The logic device 710 detects when the interlock circuit 716 is closed and directs the power source 702 to begin supplying current to the electrical load 704 along the power supply circuit 700.

The electrical shunt 234 and the fused conductive pathway 720 may be positioned relative to one another in the IFC assembly 102 such that the fused conductive pathway 720 closes the power supply circuit 700 prior to the electrical shunt 234 closing the interlock circuit 716. For example, the conductive terminals 240, 242 may protrude farther from the mating interface end 116 (shown in FIG. 1) of the IFC assembly 102 than the electrical shunt 234 such that the conductive terminals 240, 242 mate with the contacts 126 of the header assembly 104 (shown in FIG. 1) prior to the electrical shunt 234 mating with the contacts, or nodes 718, in the header assembly 104. The closing of the power supply circuit 700 prior to the closing of the interlock circuit 716 may ensure that the fuse 250 is provided along the power supply circuit 700 prior to the logic device 710 directing the power source 702 to supply power along the power supply circuit 700.

In one embodiment, the electrical shunt 234 and the fused conductive pathway 720 are positioned relative to one another in the IFC assembly 102 such that upon separation, removal or disassembly of the IFC assembly 102 from the power distribution module 106, the power supply circuit, 700 is opened prior to the opening the interlock circuit 716. For example, the electrical shunt 234 may disengage from the contacts, or nodes 718, of the interlock circuit 716 prior to the conductive terminals 240, 242 disengaging from the contacts 126 (shown in FIG. 1), or nodes 708, of the power supply circuit 700. The delayed opening of the power supply circuit 700 relative to the interlock circuit 716 provides additional time for additional electronic components, such as capacitive elements along the power supply circuit 700, to discharge built up electrical energy before removing the fuse 250 from the power supply circuit 700.

The IFC assembly 102 provides an external fuse 250 to the power distribution module 106 that may be more easily replaced than a fuse that is internal to the power distribution module 106. For example, replacement of a blown fuse 250 in the IFC assembly 102 may merely require unplugging and replacement of the IFC assembly 102 with another IFC assembly 102. Alternatively, replacement of a blown fuse 250 may merely require unplugging the IFC assembly 102 from the power distribution module 106, removal of the fuse subassembly 236 (shown in FIG. 2) from the IFC assembly 102 and replacement of the fuse 250. The unplugging and plugging of the IFC assembly 102 into an externally mounted header assembly 104 (shown in FIG. 1) provides an externally removable IFC assembly 102 and fuse 250 that is outside of and separate from the internal power supply circuit 700 of the power distribution module 106 prior to mating the IFC assembly 102 with the power distribution module 106.

In another embodiment, the IFC assembly 102 may be configured similar to the integrated fuse connector assemblies disclosed in one or more of the '838 and the '766 Applications. For example, the fuse subassembly 236 may be configured similar to the integral fuse connector assemblies described in the '838 and/or '766 Applications. By way of example only, the fuse terminals of the integral fuse connector assembly described in the '838 and/or '766 Application may be joined with the contacts 126 to provide a fused conductive pathway between the contacts 126 of the power distribution module 106.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mating with a power distribution module, the connector assembly comprising:

a header connector assembly configured to mount to the power distribution module, the header assembly including contacts connected to a power supply circuit within the power distribution module; and a fuse connector assembly configured to mate with the header assembly, the fuse connector assembly including a fuse subassembly including an insert body configured to hold a fuse and conductive terminals, the conductive terminals mounted to the insert body and configured to electrically couple with the fuse to establish a fused conductive pathway, the conductive terminals of the fuse subassembly configured to mate with the contacts in the header assembly to electrically couple the fused conductive pathway with the power supply circuit of the power distribution module, wherein the conductive terminals of the fuse connector assembly are separated from the contacts of the header connector assembly to replace the fuse in the fuse connector assembly while the contacts of the header connector assembly remain connected to the power supply circuit within the power distribution module.

2. The connector assembly of claim 1, wherein the fuse connector assembly includes an electromagnetic shield, the fuse subassembly disposed within the shield in the fuse connector assembly.

3. The connector assembly of claim 1, further comprising an interlock circuit coupled with a logic device that directs a power source of the power supply circuit when to begin or end supplying electric current through the power supply circuit based on whether the interlock circuit is closed or open, wherein the fuse connector assembly includes an electric shunt that closes the interlock circuit when the fuse connector assembly mates with the header connector assembly.

4. The connector assembly of claim 3, wherein the fused conductive pathway of the fuse connector assembly closes the power supply circuit of the power distribution module prior to the electric shunt closing the interlock circuit when the fuse connector assembly mates with the header connector assembly.

5. The connector assembly of claim 3, wherein the fused conductive pathway of the fuse connector assembly opens the power supply circuit of the power distribution module after the electric shunt opens the interlock circuit when the fuse connector assembly unmates with the header connector assembly.

6. The connector assembly of claim 1, wherein the conductive terminals are snapably coupled to the insert body of the fuse subassembly.

7. The connector assembly of claim 1, wherein the fuse connector assembly includes an inner housing located within the shield, wherein the fuse subassembly is disposed in the inner housing and is at least partially enclosed by the shield.

8. The connector assembly of claim 1, wherein header connector assembly is configured to be externally mounted to the power distribution module.

9. The connector assembly of claim 1, wherein the fuse connector assembly includes a flexible latch and a floating latch, the floating latch including opposite ends, further wherein the fuse connector assembly mates with the header assembly along a mating direction, a first one of the ends of the floating latch latches onto the header connector assembly and a second one of the ends of the floating latch latches onto the fuse connector assembly to secure the fuse connector assembly to the header connector assembly.

10. The connector assembly of claim 9, wherein the floating latch is slidably coupled to the fuse connector assembly such that the floating latch slides relative to the fuse connector assembly after engaging the header connector assembly and prior to engaging the flexible latch during mating of the fuse connector assembly to the header connector assembly.

11. The connector assembly of claim 1, wherein the fuse connector assembly includes a seal element configured to preventingress of contaminants into the fuse connector assembly.

12. A connector assembly for mating with a power distribution module having an open power supply circuit, the connector assembly comprising:

an outer housing extending from a mating interface to a back end along a longitudinal axis, the mating interface configured to mate with a header assembly mounted to an exterior surface of the power distribution module; and a fuse subassembly disposed in the outer housing, the fuse subassembly including conductive terminals that are configured to mate with contacts in the header assembly of the power distribution module, the fuse subassembly configured to retain a fuse that is electrically coupled with the conductive terminals, wherein the conductive terminals and the fuse are electrically coupled with the contacts in the header assembly to close the power supply circuit when the outer housing mates with the header assembly, further wherein the conductive terminals of the fuse subassembly are separated from the contacts in the header assembly to replace the fuse in the fuse subassembly while the contacts of the header assembly remain connected to the power supply circuit of the power distribution module.

13. The connector assembly of claim 12, wherein the outer housing is configured to disengage from the header assembly of the power distribution module to remove the fuse from the power supply circuit of the power distribution module and to open the power supply circuit.

14. The connector assembly of claim 12, further comprising an electromagnetic shield disposed in the outer housing, wherein the fuse subassembly is located in the shield.

15. The connector assembly of claim 12, further comprising a sealing member disposed around a perimeter of the mating interface of the outer housing, the sealing member preventing ingress of moisture into the outer housing from outside of the outer housing.

16. The connector assembly of claim 12, further comprising an electromagnetic shield disposed within the outer housing and an internal housing disposed within the shield, wherein the internal housing comprises an interior chamber with the fuse subassembly located in the interior chamber.

17. The connector assembly of claim 12, further comprising an electrical shunt disposed in the outer housing and configured to close an open interlock circuit of the power distribution module after the fuse subassembly closes the power supply circuit, wherein the interlock circuit is coupled with a logic device that directs a power source of the power supply circuit when to begin or end supplying electric current through the power supply circuit based on whether the interlock circuit is closed or open, the electrical shunt disposed in the outer housing.

18. The connector assembly of claim 12, wherein the fuse subassembly comprises an insert body extending between a front end and a rear end along a center axis, the insert body including parallel rails extending between the front end and the rear end and configured to receive the fuse between the parallel rails.

19. The connector assembly of claim 12, wherein the outer housing and the fuse subassembly are external to the power distribution module.

20. The connector assembly of claim 12, wherein the outer housing may be decoupled from the header assembly to replace the fuse.

21. The connector assembly of claim 1, wherein the fuse connector assembly includes an outer housing with the fuse subassembly disposed in the outer housing, the outer housing extending from a back end to a mating interface along a longitudinal axis, the mating interface configured to engage the header connector assembly when the fuse connector assembly mates with the header connector assembly, further wherein the fuse subassembly is removable from the outer housing through the mating interface of the outer housing.

22. The connector assembly of claim 1, wherein the fuse connector assembly includes an outer housing with the insert body disposed in the outer housing, and the conductive terminals of the fuse connector assembly mate with the contacts of the header assembly along a mating direction and the insert body is removable from the outer housing in a direction that is parallel to the mating direction to replace the fuse in the insert body.

23. The connector assembly of claim 12, wherein the fuse subassembly is removable from the outer housing through the mating interface of the outer housing.

24. The connector assembly of claim 12, wherein the fuse subassembly includes an outer housing and an insert body having the conductive terminals and configured to hold the fuse, further wherein the conductive terminals mate with the contacts of the header assembly along a mating direction and the insert body is removable from the outer housing in a direction that is parallel to the mating direction to replace the fuse in the insert body.

* * * * *